US006438792B1

(12) United States Patent
Cappellotto

(10) Patent No.: US 6,438,792 B1
(45) Date of Patent: Aug. 27, 2002

(54) APPARATUS FOR UNWINDING/REWINDING A SUCTION HOSE FOR DRAINING CESSPOOLS, SEPTIC TANKS AND SEWERS IN GENERAL

(75) Inventor: Luigi Cappellotto, Gaiarine (IT)

(73) Assignee: Cappellotto S.p.A., Gaiarine (IT)

( * ) Notice: Subject to any disclaimer, the term of this patent is extended or adjusted under 35 U.S.C. 154(b) by 0 days.

(21) Appl. No.: 09/562,116

(22) Filed: May 1, 2000

(30) Foreign Application Priority Data

May 3, 1999 (IT) ..... PD99A0091

(51) Int. Cl.[7] ..... B08B 3/02
(52) U.S. Cl. ..... 15/315; 15/302; 242/397.1
(58) Field of Search ..... 15/302, 315; 242/397.1

(56) References Cited

U.S. PATENT DOCUMENTS 3,371,801 A * 3/1968 Widegreen ..... 242/397.1
4,066,093 A * 1/1978 Egerstrom ..... 242/397.1
4,199,837 A * 4/1980 Fisco, Jr. ..... 15/302
4,669,145 A * 6/1987 Kehr ..... 15/302
4,922,571 A * 5/1990 Driear ..... 15/302
5,577,772 A * 11/1996 Kaiser ..... 15/302

FOREIGN PATENT DOCUMENTS

| | | |
|---|---|---|
| DE | 31 22 412 | 1/1983 |
| DE | 88 07 777 | 8/1988 |
| EP | 0 387 758 | 9/1990 |

* cited by examiner

*Primary Examiner*—Theresa T. Snider
(74) *Attorney, Agent, or Firm*—Guido Modiano; Albert Josif; Daniel O'Byrne

(57) ABSTRACT

An apparatus for unwinding/rewinding a suction hose for draining or purging cesspools, septic tanks, sewers or the like which includes, on a truck, a reel with which, in a peripheral region, a radial hose guide is associated, the hose guide including a composite am with guiding elements for the hose, wherein the arm is peripherally articulated to the reel so as to pitch, in an adjustable manner actuated by actuation elements, about an axis which is parallel to a tangent to the reel.

10 Claims, 3 Drawing Sheets

APPARATUS FOR UNWINDING/REWINDING A SUCTION HOSE FOR DRAINING CESSPOOLS, SEPTIC TANKS AND SEWERS IN GENERAL

BACKGROUND OF THE INVENTION

The present invention relates to an apparatus which is particularly but not exclusively useful for unwinding/rewinding a suction hose for draining cesspools, septic tanks, sewers or the like.

Conventional trucks equipped with apparatuses particularly adapted for draining or purging cesspools, septic tanks, sewers or the like substantially comprise a tank and associated equipment adapted to aspirate the sewage and the various residues from the cesspool or septic tank into the tank.

In particular, for draining or purging uses a flexible hose is usually lowered from the top of the tank.

Since any chokes in the hose can be highly damaging during work, the hose is guided, in its movement, by a particular dedicated apparatus which substantially comprises a reel having a vertical rotation axis and on which the hose is wound; a hose guide, comprising a composite arm with means for guiding the hose, is associated therewith in a peripheral region.

In commercially available embodiments, the hose guides are normally associated proximate to the peripheral tangential region of the reel so as to be articulated for movements about a rotation axis which is substantially vertical and lies proximate to the peripheral region of the reel.

Although this movement can facilitate hose positioning operations in some cases, it can nevertheless cause choking of the hose, with sometimes severe consequences for the hose.

A rotation of the arm in the same direction as the reel is in fact practically safe and therefore can be performed without risk; the opposite action, however, i.e., a rotation of the arm in the opposite direction with respect to any rotation of the reel, may inevitably cause choking of a section f the hose, with consequent malfunction of, and even damage to, the hose.

SUMMARY OF THE INVENTION

The aim of the present invention is to provide an apparatus for unwinding/rewinding a suction hose for draining or purging cesspools, septic tanks or sewers and the like, whose structure solves the drawbacks noted above in equipment having the same functions and is, in particular, able to allow high flexibility in hose positioning but without the risk of choking the hose.

In relation to this aim, an important object of the present invention is to provide an apparatus whose structure allows a simple and functional use which is adapted for the most disparate requirements and fields of application.

Another object of the present invention is to provide an apparatus whose structure is considerably strong and allows to adequately and effectively guide the hose both during unwinding and during rewinding.

Another object of the present invention is to provide an apparatus whose structure can be adapted to the different types of truck and tank.

Another object of the present invention is to provide an apparatus whose structure can be manufactured at competitive costs with respect to apparatuses having a similar functionality.

These and other objects which will become better apparent hereinafter are achieved by an apparatus for unwinding/rewinding a suction hose for draining or purging cesspools, septic tanks or sewers and the like, of the type which comprises, on a truck, a reel with which, in a peripheral region, a coaxial hose guide is associated, said hose guide comprising a composite arm with guiding means for said hose, said apparatus being characterized in that said arm is peripherally articulated to said reel so as to pitch, in an adjustable manner actuated by actuation means, about an axis which is parallel to a tangent to said reel.

BRIEF DESCRIPTION OF THE DRAWINGS

Further characteristics and advantages of the apparatus according to the present invention will become better apparent from the description of an embodiment thereof, illustrated only by way of non-limitative example in the accompanying drawings, wherein.

DESCRIPTION OF THE PREFERRED EMBODIMENTS

Figure 1:
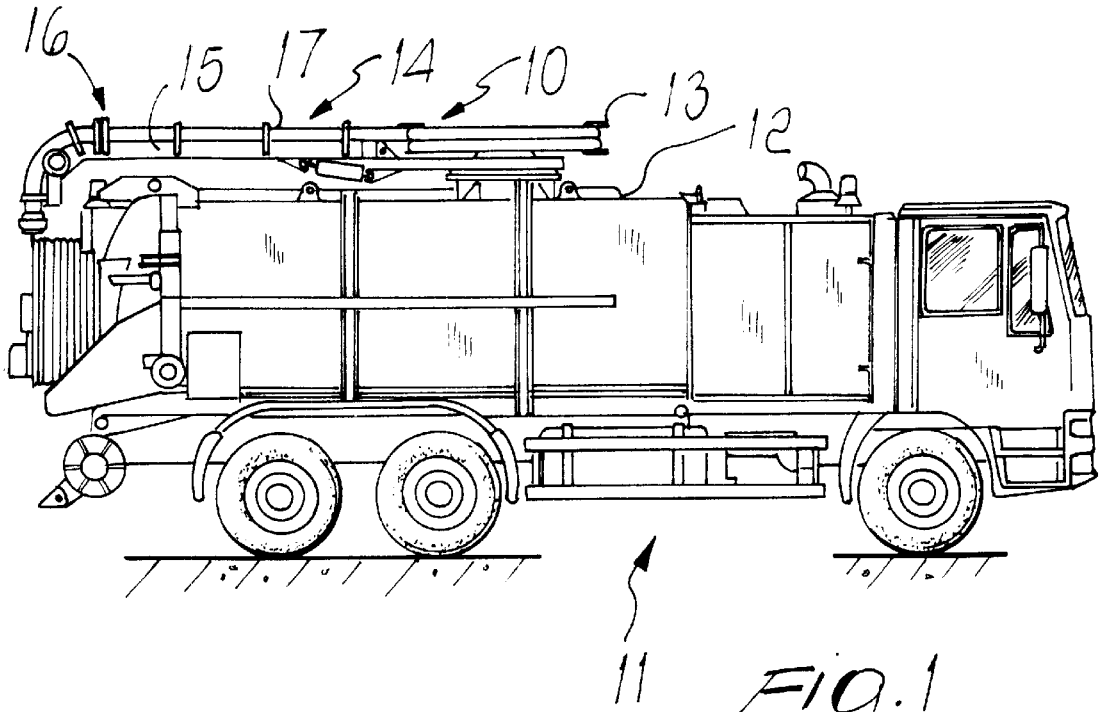
FIG. 1 is an orthographic projection view of an apparatus according to the invention, fitted above the tank of a truck.
Figure 2:
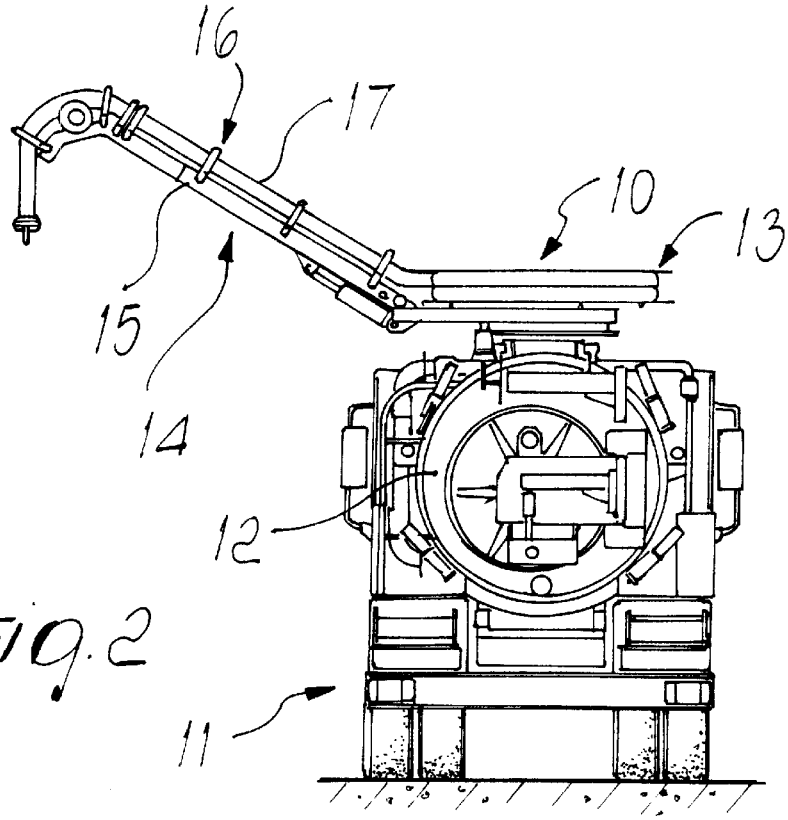
FIG. 2 is another orthographic projection view of the apparatus of FIG. 1.
Figure 3:
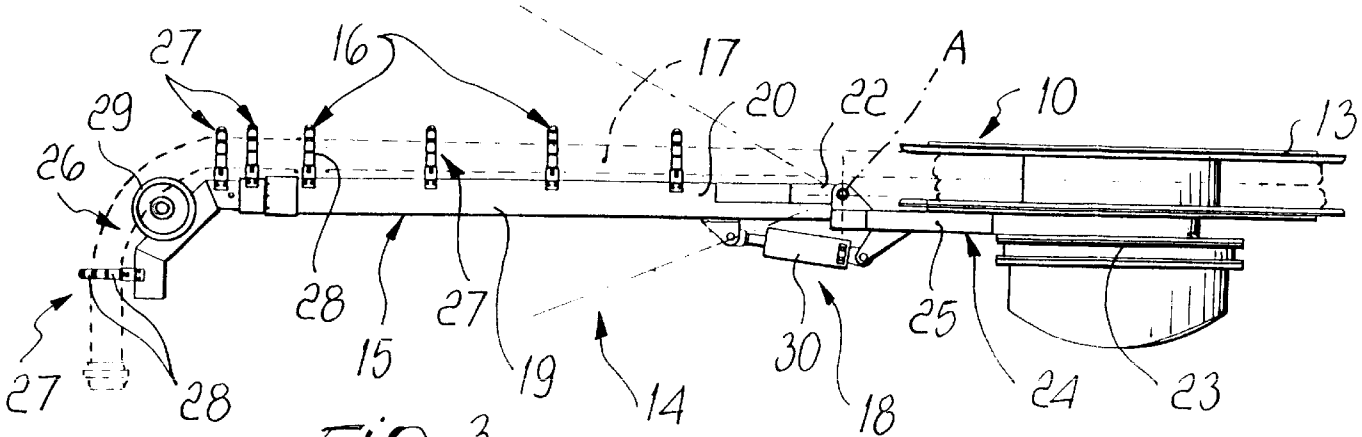
FIG. 3 is an orthographic projection view of the apparatus of FIG. 1.
Figure 4:
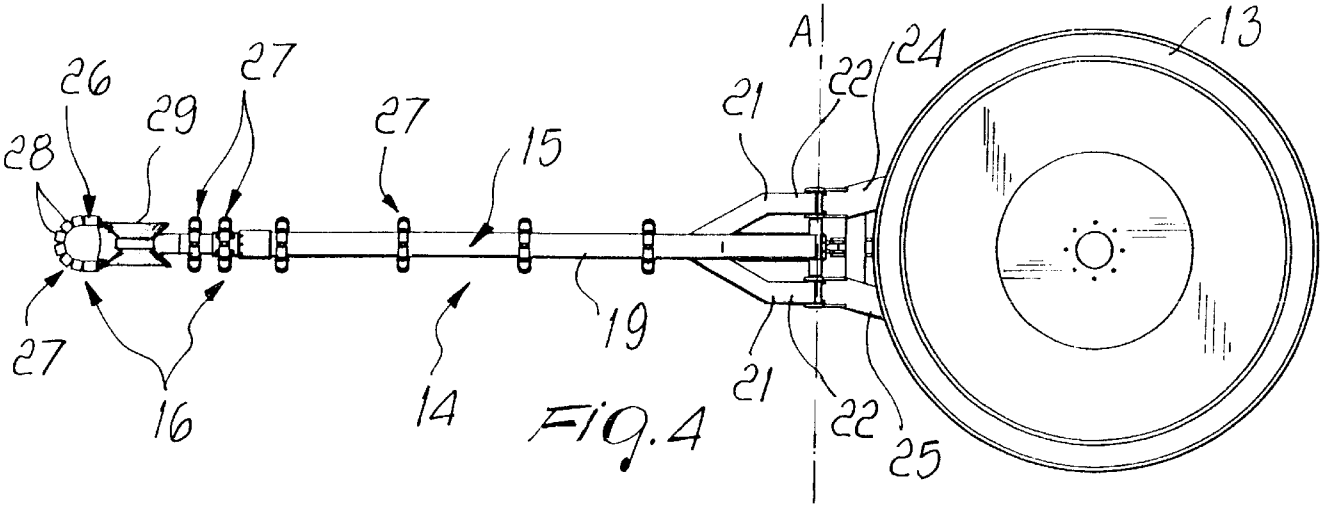
FIG. 4 is another orthographic projection view of the apparatus of FIG. 1.
Figure 5:
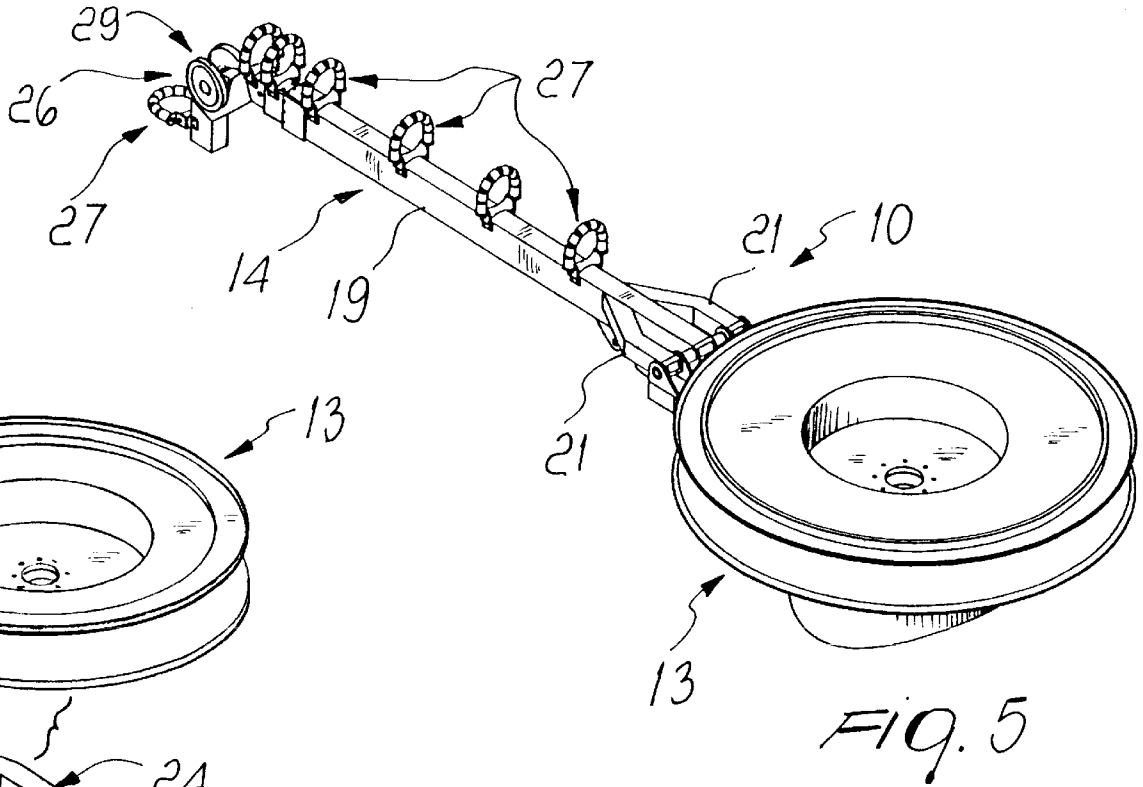
FIG. 5 is a perspective view of the apparatus of FIG. 1.
Figure 6:
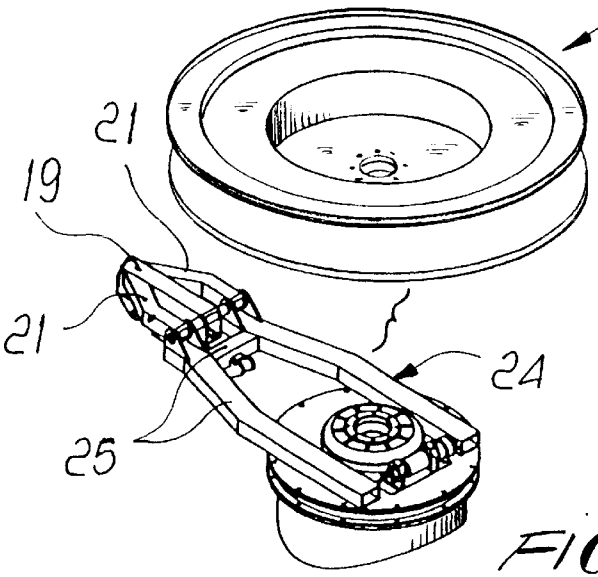
FIG. 6 is an exploded view of a detail of the apparatus of FIG. 1.

With reference to the above Figures, an apparatus for unwinding/rewinding a suction hose for draining or purging cesspools, septic tanks, sewers or the like having the structure according to the invention is generally designated by the reference numeral 10.

In particular, the apparatus 10 comprises, on a truck 11 equipped with a tank 12, a reel 13 which has a vertical axis of rotation and with which a hose guide, generally designated by the reference numeral 14, is associated in a peripheral region; the hose guide extends radially and includes a composite arm 15 with guiding means, generally designated by the reference numeral 16, for the hose, designated by the reference numeral 17.

The arm 15 is articulated peripherally with respect to the reel 13 so as to pitch in an adjustable manner, actuated by actuation means, generally designated by the reference numeral 18, about an axis (A) which is parallel to a tangent to said reel 13 (which in this case is substantially horizontal).

In particular, the arm 15 includes a central tubular longitudinally elongated body 19 to which two reinforcement elements 21 are fixed at the end 20 that is proximate to the reel 13; the free ends 22 of the reinforcement elements are hinged coaxially to the body 19.

The reel 13 is associated with a base 23 for connection to an adapted region of the tank 12 of the truck 13 and the arm 15 can rotate as a whole with respect to tank.

In particular, the arm 15 is articulated to the base 23 by means of a composite bracket 24 which is partially fixed to the base.

More specifically, the bracket 24 includes a plurality of welded tubular elements 25.

The central body 19 is shaped so as to form a guiding nose 26 for lowering the hose 17.

The guiding means 16 includes a plurality of rings 27 which are provided with sliding rollers 28 and are spaced one after another at preset intervals along the body 19.

A roller 29 which has a horizontal axis is also associated with the body 19 at the beginning of the nose 26, where the hose 14 bends sharply.

In this embodiment, the actuation means comprise a fluid-actuated cylinder 30 whose ends are hinged respectively to the body 19 and to the bracket 24.

In practice it has been observed that the present invention has achieved the intended aim and objects.

It should in fact be noted that though maintaining high flexibility in application and hose positioning, the apparatus having the structure according to the invention prevents choking in any section of the hose and in any case both during unwinding and during rewinding of the hose.

It should also be noted that the apparatus having the structure according to the invention can be applied substantially to any type of tank and truck and optionally even to those that are currently already in use.

It should also be noted that the apparatus having the structure according to the invention achieves its application purposes while having a structure which is substantially simple and can be manufactured at competitive costs with respect to apparatuses having a similar functionality.

The present invention is susceptible of numerous modifications and variations, all of which are within the scope of the inventive concept.

The technical details may be replaced with other technically equivalent elements.

The materials and the dimensions may be any according to requirements.

The disclosures in Italian Patent Application No. PD99A000091 from which this application claims priority are incorporated herein by reference.

What is claimed is:

1. An apparatus for unwinding/rewinding a suction hose for draining cesspools, septic tanks and sewers, mountable on a truck, including a supporting region, the apparatus comprising: a reel rotatable about a rotation axis thereof and adapted to hold a suction hose; a coaxial hose guide connected to said reel in a peripheral region thereof, said hose guide including a composite arm provided with guiding means for said hose, a base being connected to said reel, said arm being articulated to said base so as to be integral with said reel and said base; and actuation means for actuating the arm to perform pitching motions in an adjustable manner, about an axis which is parallel to a tangent to said reel, rotation of said base and said reel being accompanied by a corresponding rotation of said arm.

2. The apparatus of claim 1, wherein said arm comprises: a longitudinally elongated tubular central body; and two reinforcement elements, fixed at an end of the body that lies proximate to said reel, said reinforcement elements including free ends thereof, which are hinged coaxially to said central body.

3. The apparatus of claim 2, wherein said body is shaped so as to form a guiding nose for lowering said hose.

4. The apparatus of claim 3, wherein said guiding means comprise a plurality of rings each provided with sliding rollers, said rings being spaced at preset intervals along said body.

5. The apparatus of claim 4, further comprising a roller, mounted on a horizontal axis located at a starting end of said nose where the suction hose bends sharply downwards to extend over said nose of the composite arm.

6. The apparatus of claim 1, wherein said base is connected to said supporting region of the truck, said arm being articulated to said base, said base being rotatable with respect to said supporting region of the truck.

7. The apparatus of claim 6, wherein said base is rotatable about a rotation axis which coincides with the rotation axis of said reel, said rotation axis being substantially vertical.

8. The apparatus of claim 7, further comprising a composite bracket, which is partially fixed to said base, said arm being articulated to said base by way of said composite bracket.

9. The apparatus of claims 8, wherein said bracket comprises a plurality of welded tubular elements.

10. The apparatus of claim 8, wherein said actuation means comprises a hydraulic cylinder, said hydraulic cylinder being hinged at opposite ends thereof to said body, and to said bracket, respectively.

* * * * *